US006651629B2

(12) United States Patent
McCoy et al.

(10) Patent No.: US 6,651,629 B2
(45) Date of Patent: Nov. 25, 2003

(54) INTERNAL ENERGIZABLE VOLTAGE OR CURRENT SOURCE FOR FUEL INJECTOR IDENTIFICATION

(76) Inventors: John C. McCoy, deceased, late of Fayetteville, TN (US); by Mary B. McCoy, legal representative, 290 Mimosa Rd., Fayetteville, TN (US) 37334; Lou Vierling, 17414 Sprenger, East Detroit, MI (US) 48021

( * ) Notice: Subject to any disclaimer, the term of this patent is extended or adjusted under 35 U.S.C. 154(b) by 129 days.

(21) Appl. No.: 10/038,050

(22) Filed: Jan. 4, 2002

(65) Prior Publication Data

US 2002/0112698 A1 Aug. 22, 2002

Related U.S. Application Data

(60) Provisional application No. 60/259,631, filed on Jan. 4, 2001.

(51) Int. Cl.[7] ..... F02D 41/20; F02M 51/06

(52) U.S. Cl. ..... 123/480; 73/119 A; 123/478

(58) Field of Search ..... 123/478, 480, 123/486; 73/119 A

(56) References Cited

U.S. PATENT DOCUMENTS

| | | | | |
|---|---|---|---|---|
| 3,575,145 A | | 4/1971 | Steiger | 123/357 |
| 3,786,344 A | | 1/1974 | Davis et al. | 323/267 |
| 3,942,485 A | | 3/1976 | Suda et al. | 123/490 |
| 3,971,348 A | | 7/1976 | Scofield | 123/490 |
| 4,181,944 A | | 1/1980 | Yamauchi et al. | 701/108 |
| 4,190,022 A | | 2/1980 | Long | 123/490 |
| 4,313,412 A | | 2/1982 | Hosaka et al. | 123/480 |
| 4,350,132 A | | 9/1982 | Harsch et al. | 123/490 |
| 4,391,253 A | | 7/1983 | Ito | 123/478 |
| RE31,391 E | | 9/1983 | Davis et al. | 361/154 |
| 4,402,294 A | | 9/1983 | McHugh et al. | 123/480 |
| 4,416,237 A | | 11/1983 | Aoki et al. | 123/675 |
| 4,469,074 A | | 9/1984 | Takao et al. | 123/492 |
| 4,618,908 A | | 10/1986 | Anttila | 361/187 |
| 4,656,989 A | | 4/1987 | Yakuwa | 123/490 |
| 4,864,457 A | | 9/1989 | Christian et al. | 361/153 |
| 4,905,120 A | | 2/1990 | Grembowicz et al. | 361/154 |
| 4,953,056 A | | 8/1990 | Yakuwa et al. | 361/154 |
| 4,972,293 A | | 11/1990 | Verner | 361/187 |
| 4,972,996 A | | 11/1990 | Cerny | 239/585.4 |
| 5,044,563 A | | 9/1991 | Mesenich | 239/585.4 |
| 5,235,954 A | | 8/1993 | Sverdlin | 123/447 |
| 5,575,264 A | * | 11/1996 | Barron | 123/486 |
| 5,720,261 A | | 2/1998 | Sturman et al. | 123/446 |
| 5,808,471 A | | 9/1998 | Rooke et al. | 324/546 |
| 5,829,460 A | | 11/1998 | Acevedo | 134/102.2 |
| 5,835,330 A | | 11/1998 | Kirschner et al. | 361/152 |
| 5,920,004 A | | 7/1999 | Gottshall et al. | 73/1.36 |
| 5,954,030 A | | 9/1999 | Sturman et al. | 123/446 |
| 6,036,120 A | | 3/2000 | Varble et al. | 239/585.1 |
| 6,065,684 A | | 5/2000 | Varble et al. | 239/5 |
| 6,120,005 A | | 9/2000 | Wright | 251/129.1 |
| RE37,807 E | * | 7/2002 | Shinogle et al. | 123/480 |
| 6,418,913 B1 | * | 7/2002 | Schmidt et al. | 123/480 |
| 6,536,268 B1 | * | 3/2003 | Vierling et al. | 73/119 A |

FOREIGN PATENT DOCUMENTS

| | | |
|---|---|---|
| EP | 0195194 | 1/1986 |
| EP | 0492876 | 7/1992 |
| JP | 10288119 | 10/1998 |
| WO | 0063545 | 10/2000 |

* cited by examiner

*Primary Examiner*—Tony M. Argenbright

(57) ABSTRACT

A fuel injector assembly includes a plurality of fuel injectors (22), each of which may have a different performance characteristic. After the performance characteristics have been determined, an internal, energizable voltage or current source (28) is provided within the injector housing (23). Each time the vehicle ignition is turned on, a controller (26) queries each injector (22) to obtain a signal from the individual, internal, energizable voltage or current sources (28). The controller (26) then uses the output of the internal voltage or current source (28) as an indication of the performance characteristics of each injector (22). The controller then customizes the power signal supplied to each injector to accommodate for different performance characteristics.

13 Claims, 2 Drawing Sheets

INTERNAL ENERGIZABLE VOLTAGE OR CURRENT SOURCE FOR FUEL INJECTOR IDENTIFICATION

CROSS REFERENCE TO RELATED APPLICATOINS

This application claims priority to the U.S. Provisional Application having Ser. No. 60/259,631 filed Jan. 4, 2001.

BACKGROUND OF THE INVENTION

This invention generally relates to fuel injector control systems. More particularly, this invention relates to a strategy for identifying particular fuel injectors to individually control injectors based upon their individual characteristics.

Fuel injectors are often incorporated into vehicle engine systems for providing fuel to the engine. One type of fuel injector includes a spool valve that controls the amount of fuel provided by the injector to the engine. Controlling the spool valve typically is done electronically by selectively powering open and close coils, respectively, to move the spool into the position necessary to achieve the desired fuel flow rate.

Due primarily to manufacturing tolerances, every fuel injector does not perform identically. There are two main performance characteristics that typically vary from injector to injector. These include the injector's response time to the electrical signals to drive the coils and the actual rate of fuel supplied by the injector. These are often referred to as the gain and offset of the injector.

Because there are variations between injectors, optimum engine performance requires a strategy for specifically controlling each injector to accommodate the individual performance characteristics of each injector. One proposal is shown in U.S. Pat. No. 4,972,293. In that arrangement, a strategy is utilized to identify individual injectors and to then modify the manner in which each injector is controlled to achieve a desired performance. The particular strategy disclosed in that document is somewhat cumbersome.

There is a need for improved strategies for identifying individual injectors and customizing the control of each injector to accommodate for differences between individual injectors. This invention provides a unique way of accomplishing that end.

SUMMARY OF THE INVENTION

In general terms, this invention is a fuel injector assembly that accommodates for differences in performance between individual injectors.

A fuel injector assembly designed according to this invention includes at least one coil. In some examples, the injector assembly includes an open coil and a close coil. At least one driver is associated with the coil to selectively power the coil to achieve a desired fuel flow rate through the injector assembly. The coil and driver are housed within a fuel injector housing for each individual injector. A power source that is external to the fuel injector housing provides the power to energize the driver and drive the coil. Each injector includes an energizable voltage or current source within the fuel injector housing that is energized by the external power source and then provides an output that is indicative of the particular characteristics of the fuel injector. The indication provided by the internal, energizable voltage or current source permits the controller of the assembly to customize the signals provided to the individual fuel injectors to accommodate for the particular performance characteristics of each injector.

In one example, the internal, energizable power source is a voltage source. In another example, the internal, energizable power source is a current source.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
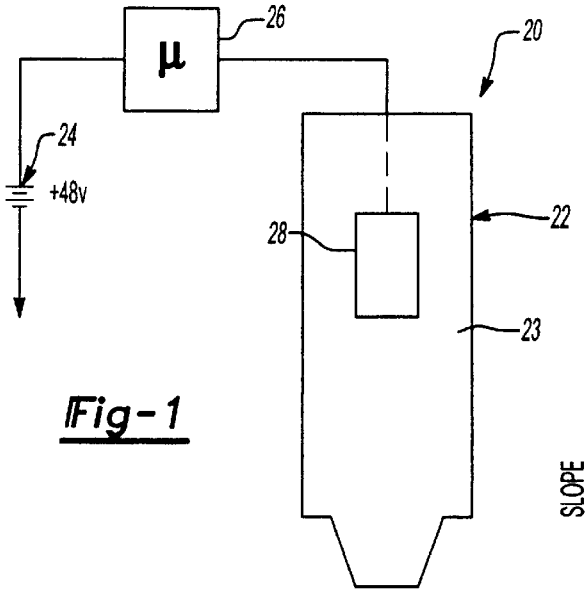
FIG. 1 schematically illustrates selected portions of a fuel injector assembly designed according to this invention.

A fuel injector assembly 20 includes a plurality of fuel injectors 22. A single injector 22 is illustrated in FIG. 1 for simplification purposes. Those skilled in the art realize that there are a plurality of fuel injectors associated with a vehicle engine. Each of the injectors has components contained within an injector housing 23. An external power source 24 provides power to operate the injector 22. A control circuit 26 includes a microprocessor that is programmed to provide powering signals to each fuel injector to obtain the desired injector performance to achieve a desired fuel flow rate.

The operation of fuel injectors and the necessary circuitry and programming to operate them is well known in the art. This invention focuses upon individualizing or customizing the control signals provided to each injector to accommodate for variations in performance from injector to injector.

Identifying injector performance characteristics includes determining the slope or gain associated with the injector. This phenomenon typically is dictated by the electrical response time of the components within the injector. The other performance characteristic that typically needs to be identified is the offset or actual rate of fuel flow from the injector. Ways of determining these two factors are discussed, for example, in our co-pending application having Ser. No. 09/536,365, which was filed on Mar. 27, 2000, now U.S. Pat. No. 6,516,658. The teachings of that specification are incorporated into this description by reference.

Figure 2:
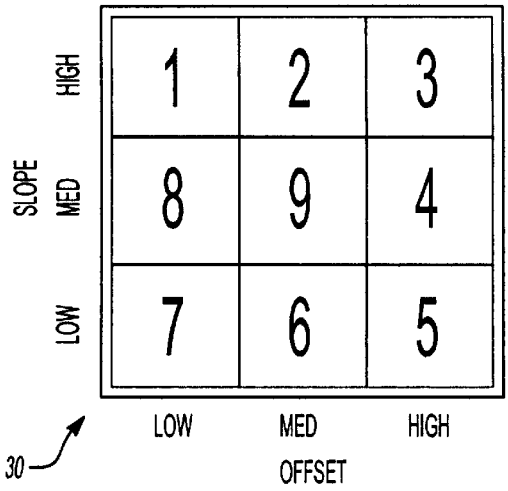
FIG. 2 graphically illustrates a strategy for identifying individual injectors and their performance characteristics.

According to this invention, after an injector has been manufactured, but before it is installed in a vehicle engine system, it is tested to determine its performance characteristics. The determined characteristics then provide information to sort or categorize injectors. FIG. 2 graphically illustrates one strategy for categorizing individual injectors according to their performance characteristics. In this example, three different ranges of the slope and three different ranges of the offset for injectors are predetermined. Given this description, those skilled in the art will be able to select appropriate parameters to set the different ranges. When the slope or gain of the injector is determined, that value is then categorized as a low, medium or high value. When the offset of the injector is determined, it is then categorized as a low, medium or high value. The two values then provide an identification for the injector based upon a category within which the values fall. For example, if an injector has a medium slope and a high offset, it fits within the category 4 of the matrix of FIG. 2.

Once the appropriate category for the injector is identified, the injector preferably is provided with an internal, energizable voltage or current source 28 that provides an electrical output that is indicative of the category within which the injector falls. The controller of the injector assembly then will be able to utilize the output of the energizable voltage or current source (after a suitable analog-to-digital conversion) to identify the category to which each injector belongs. The controller preferably is programmed to provide powering signals to each injector consistent with the requirements of the particular category so that a consistent injector performance is achieved from a fuel assembly even though there may be variations in the performance characteristics of the particular injectors within the overall assembly.

Figure 3:
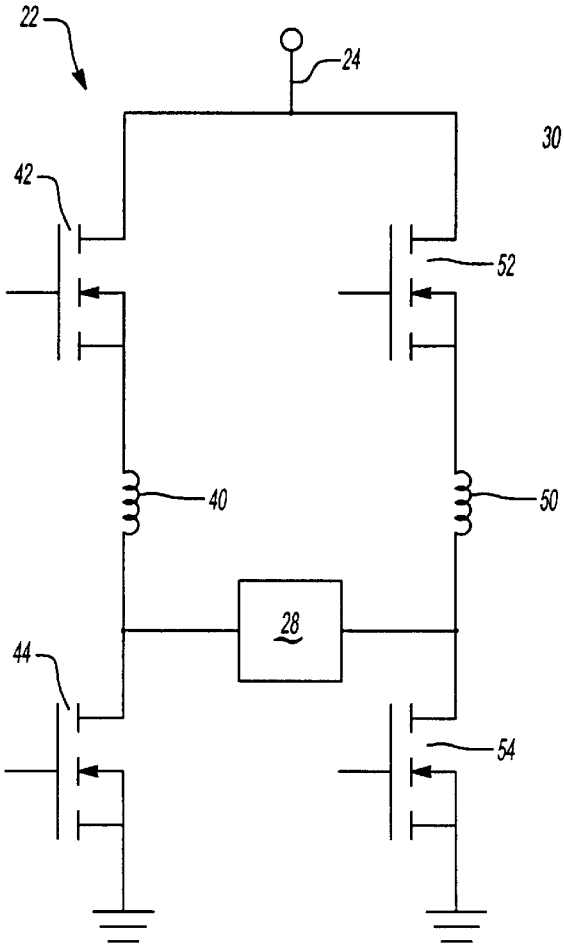
FIG. 3 schematically illustrates portions of a fuel injector designed according to this invention.

FIG. 3 schematically illustrates selected portions of the internal components of the injector 22. A close coil 40 is driven by selectively energizing a high side driver 42 and low side driver 44. When the close coil 40 is energized, a valve, which preferably is a spool valve, is closed. An open coil 50 receives power from the external power source 24 by selectively energizing a high side driver 52 and low side driver 54. As known in the art, selectively controlling the open coil 50 and close coil 40 provides for selectively controlling the operation of the valve within the injector 22.

An energizable voltage or current source 28 preferably is placed within the injector circuitry within the housing 23. The energizable voltage or current source 28 preferably receives power from the external power source 24 and then generates an output signal that is indicative of the categorization of the injector. In the illustration of FIG. 3, the energizable voltage or current source 28 is coupled between the low side of the closed coil 40 and the low side of the open coil 50.

In one example, the energizable voltage or current source 28 receives power by operating selected drivers associated with the coils within the injector. In this example, no additional wiring is required in the wire harness to the injectors. In another example, a separate wire connection (not illustrated) is provided for energizing the voltage or current source 28 and reading signals from that voltage or current source. This represents a slight addition to the wire harness requirements for the fuel injector assembly but may be advantageous in situations, to avoid any signal distortion caused by the operation of the coils 40 or 50, for example.

Figure 4:
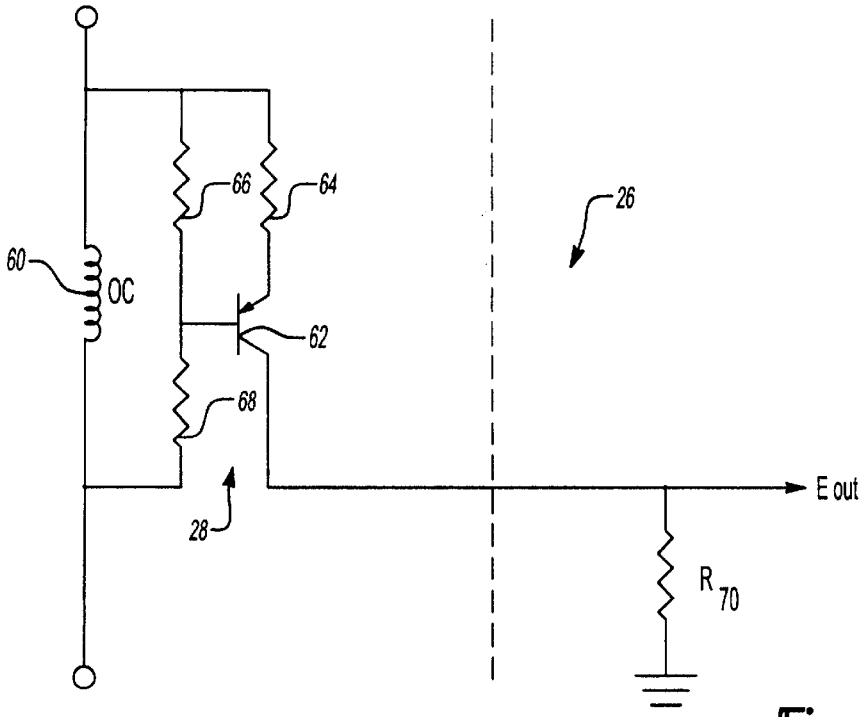
FIG. 4 illustrates one example internal, energizable current source arrangement useful with an assembly designed according to this invention.

FIG. 4 illustrates an example energizable current source. To activate this circuit, a voltage is placed across the coil 60. This example includes a single coil 60 that controls the open or closed condition of the injector. Such arrangements are generally known where the coil and valve portion of the injector operate such that when the coil is energized, the valve is switched from a closed state to an open state. The valve remains in that state until the coil is again energized, typically with a pulse excitation signal, to switch the valve to the other state.

The voltage across the coil 60 also appears across the series combination of resistors 66 and 68. The resistor 64, which determines the current output, has 0.6 volt less voltage than the resistor 66 in one example. The output current of the current source 28 is given by the equation: $I_{out}$ $(E_{R66} - 0.6)/R64$. When this current flows through the resistor 70, in the controller, a voltage proportional to the output current is developed.

Figure 5:
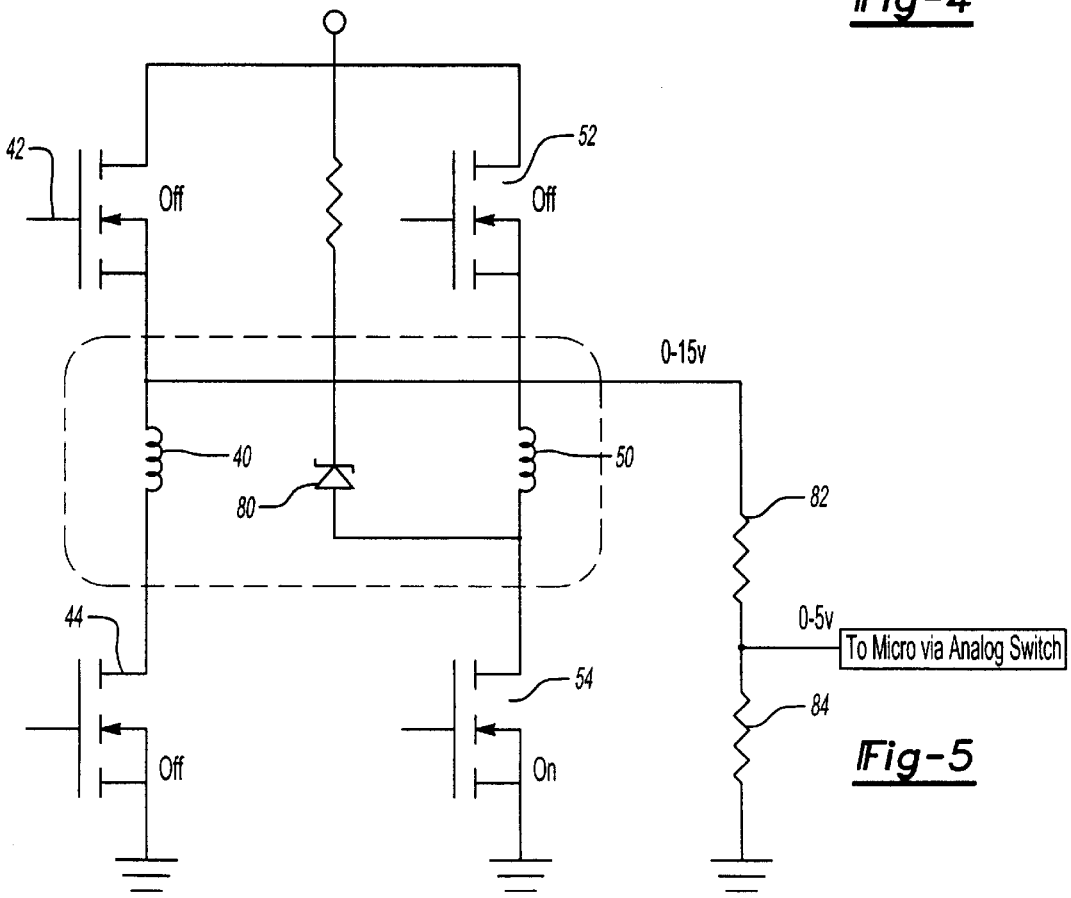
FIG. 5 schematically illustrates another example assembly designed according to this invention.

Another example embodiment (shown in FIG. 5) includes a zener diode 80 as a voltage reference source. In this example, the zener diode 80 is coupled between the high side of one coil and the low side of the other. Turning on the low side driver 54 energizes the zener diode 80. The resistors 82 and 84 ensure that the output to the controller 26 is within an acceptable range.

In one example, every time the vehicle ignition is turned on, the controller 26 preferably polls each injector by controlling the energization of the internal, energizable voltage or current source 28 for each injector. After the controller 26 determines the category within which each injector belongs, the appropriate control signals are provided to each to control fuel flow to the engine to achieve the desired vehicle operation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A fuel injector assembly for use in supplying fuel to a vehicle engine, comprising:

at least one coil that is selectively energized such that the injector will supply fuel to the engine;

at least one driver that controls energization of the coil;

an injector housing that houses the coil and driver;

a power source external to the injector housing; and an energizable voltage source that is housed within the injector housing and is energized by the external power source to provide a voltage that indicates a performance characteristic of the injector.

2. The assembly of claim 1, wherein the voltage source voltage provides an indication of a gain and offset of the injector.

3. The assembly of claim 1, including a controller that causes the external power source to energize the energizable voltage source and then samples a voltage provided by the voltage source.

4. The assembly of claim 3, wherein the controller operates the driver to energize the coil responsive to the sampled voltage.

5. The assembly of claim 1, including an open coil that is selectively energized so that the injector will supply fuel and a close coil that is selectively energized such that the injector will not supply fuel and including a plurality of drivers that control operation of the coils.

6. The assembly of claim 5, wherein the voltage source is coupled between the low side of the open coil and the low side of the close coil.

7. A fuel injector assembly for use in supplying fuel to a vehicle engine, comprising:

at least one coil that is selectively energized such that the injector will supply fuel to the engine;

a driver that controls energization of the coil;

an injector housing that houses the coil and driver;

a power source external to the injector housing; and an energizable current source that is housed within the injector housing and is energized by the external power source to provide a current that indicates a performance characteristic of the injector.

8. The assembly of claim 7, wherein the current source provides a current that is an indication of a gain and offset of the injector.

9. The assembly of claim 7, including an open coil and a close coil and a plurality of drivers for selectively energizing the coils and wherein the current source is coupled between the low side of the open coil and the low side of the close coil.

10. The assembly of claim 7, including a controller that causes the external power source to energize the energizable current source and then samples a current provided by the current source.

11. The assembly of claim 10, wherein the controller operates the driver to energize the coil responsive to the sampled current.

12. A method of operating a plurality of fuel injectors that each have a unique performance characteristic, comprising the steps of:

identifying a plurality of performance characteristic classifications;

determining in which of the classifications each of the injectors belongs;

providing each injector with an energizable voltage source that is energized by a power source outside of the injectors and provides a voltage that is an indication of the classification into which each injector is classified;

sampling the voltage from each energizable voltage source; and powering each injector according to the classification of each injector.

13. A method of operating a plurality of fuel injectors that each have a unique performance characteristic, comprising the steps of:

identifying a plurality of performance characteristic classifications;

determining in which of the classifications each of the injectors belongs;

providing each injector with an energizable current source that is energized by a power source outside of the injectors and provides a current that is an indication of the classification into which each injector is classified;

sampling the current from each energizable current source; and powering each injector according to the classification of each injector.

* * * * *